US005185899A

United States Patent [19]

Urbani

[11] Patent Number: 5,185,899

[45] Date of Patent: Feb. 16, 1993

[54] APPARATUS FOR SLUDGE REMOVAL

[75] Inventor: William G. Urbani, Stockton, Calif.

[73] Assignee: Industrial Innovations, Inc., Stockton, Calif.

[21] Appl. No.: 631,710

[22] Filed: Dec. 20, 1990

[51] Int. Cl.[5] ..... B08B 9/08

[52] U.S. Cl. ..... 15/93.1; 15/3; 15/4; 37/4; 414/467

[58] Field of Search ..... 15/3, 4, 93.1, 340.1; 414/304, 325, 467; 37/4, 126 R, 124, 126 AE

[56] References Cited

U.S. PATENT DOCUMENTS 4,407,035 10/1983 Lindqvist ..... 15/3

*Primary Examiner*—Edward L. Roberts
*Attorney, Agent, or Firm*—Townsend and Townsend

[57] ABSTRACT

A vehicle for the removal of sludge from the interior bottom of liquid storage tanks is disclosed. The vehicle includes a gathering header at the lead edge of the vehicle and a gathering arm extendable out over the header. The gathering arm reaches out and gathers sludge between the header and arm urging the sludge toward the header of the vehicle and the vehicle towards the sludge. The gathering header includes a floor mounted brass scraper and a cross feeding auger. The cross feeding auger in combination with the header body receives the material forced into the header by the gathering arm and directs it to a central portion of the header. Underlying the central portion of the header there is positioned a super charging auger series feeding a positive displacement pump. In operation, a small amount of cutter stock is introduced in the super charging auger to ensure lubricity of the positive displacement pump and a relatively large amount of cutter stock is introduced after the pump for dissolving sludge received into the discharge line. The vehicle discharges the dissolved sludge through the discharge line to a suitable container exterior of the storage tank. There results a light and portable sludge removing vehicle which can be passed in pieces through the manhole of a tank, assembled, and maneuvered without the loss of traction that has hindered similar vehicles in the past.

32 Claims, 5 Drawing Sheets

APPARATUS FOR SLUDGE REMOVAL

This invention relates to sludge removal from the bottom surface of liquid storage tanks. More particularly, an apparatus and process for the removal of accumulated sludge at the bottom of liquid storage tanks such as those found on oil storage tank farms and transporting tankers is set forth.

BACKGROUND OF THE INVENTION

Tanks that store liquids, especially crude oil, have to be periodically cleaned. While the discussion of the prior art that follows is primarily directed to the cleaning of shore side tanks for the storage of all liquids, the reader will understand that the following invention relates to flat bottom liquid storage tanks.

For example, oil storage tanks, especially those tanks that typically collect and store crude oil, accumulate sludge. This sludge constitutes both the gravitationally classified heavier petroleum products as well as heavy impurities that are entrained in the crude oil as it is delivered to the storage tank. Such heavy impurities can include solids entrained in the crude oil as it is extracted from the production site, rust and waste materials accumulated during transport and handling of the crude, and even debris thrown or inadvertently dropped into either the crude or the myriad of containers receiving and handling the crude before its arrival in the storage facility.

An example of how sludge preferentially occurs in shore side crude oil storage tanks can be understood from the unloading of transporting oil tankers. Oil tankers usually have systems for cleaning their oil transporting bottoms. These systems are typically activated during off loading. Naturally, the sludge and debris accumulated by such systems ends up within the shore side crude oil storage tank.

The size of such oil storage tanks constitutes another problem. Typically, such tanks are large—tanks are known that are in the order of 300 feet in diameter. Dependent upon the interval between cleaning and the type of crude handled, sludge can accumulate in great volume. It is known for sludge to be in the order of 20 feet thick, although a more reasonable and normal accumulation of such sludge is in the order of 2 feet of depth.

The accumulation of such sludge requires that eventually the sludge must be removed. Sludge can accumulate to the point where it interferes with the designed capacity of the tank. Additionally, the sludge can cause problems; an example of the problems caused by the accumulation of such sludge is typified by the interaction of an accumulation of sludge with the top of the tank.

Crude oil storage tanks are typically equipped with floating tops to minimize the gas-air space above the stored material in the tank. When the tanks are pumped dry, the tops descend and are designed to rest on legs that protrude downward into contact with the bottom of the tank. Unfortunately, when the tanks become full of sludge at their bottoms, the function of the tops in settling on their legs is interfered with. Specifically, the tops settle onto the sludge and become cocked with respect to the tank. When this occurs, serious damage to the floating top of the tank, as by bending at the floating top of the tank can occur.

The bottom of an oil tank with accumulated sludge is a hostile environment containing many conditions that render the removal of the sludge and the cleaning of the tank bottom difficult. First, the tank contains a potentially explosive atmosphere. Care must be taken not to initiate an explosion precipitating spark. Further, safety requires that the atmosphere interior of the tank be rendered non explosive. This is presently accomplished by venting.

Even venting is not without its problems. Air pollution regulations generally prohibit venting of such crude oil storage tanks to the atmosphere, except where no other practical alternative can be found. At present, venting of such tanks during cleaning is permitted as a so-called exception to laws relating to air pollution. If a process or apparatus for the cleaning of such tanks could be found that did not require such venting, pollution could be reduced.

Further hazards present in the tank cleaning process are present. Tank bottoms can be and usually are fragile. While such bottoms are designed to handle the static fluid pressures of liquids, they are not designed to receive the loading cause by vehicles passing over their bottom surfaces. Heavy vehicles cannot be used for such tank cleaning. Such heavy vehicles traversing such tank bottoms can cause damage to the tank bottoms and even break through the bottoms themselves. Further, a main reason for the requirement of removal of the sludge at the bottom of the tank can be the necessity for replacement of the tank bottom. Such tank bottoms often have to be replaced due to corrosion—either cause by electrolysis, moisture, or even acidic components within the stored liquids. Clearly, where the bottom of the tank is so fragile that it must be replaced, breakage of the tank bottom with the accompanying leakage and loss of contained materials is to be anticipated.

Lastly and most importantly such tanks bottoms are slippery. What is present on the bottom of the tank is a smooth metallic surface lubricated by the wet sludge. This bottom surface constitutes a low traction environment where any vehicle can slip. Since only relatively light vehicles can safely be used over the tank bottoms, the problem of obtaining sufficient traction is especially aggravated.

It has been known in the past to clean such tanks by cutting a large access aperture in the tanks side. Such cutting is usually accomplished by utilizing a gas torch, mechanical saw or a high water pressure jet (in the order of 60,000 psi) to assure the absence of an explosion exciting flame or spark. Thereafter, once an access hole has been cut, the tank is vented and entry is made for cleaning. It is to be noted that in such cleaning, conventional manholes on the tank sides are usually not used; typically the access required for such cleaning exceeds the dimension of such manholes.

Transport of the extracted sludge has constituted another problem. As the sludge is usually a paste like substance having a, consistency less than that of a solid but too viscous to form a liquid, removal is anything but easy. Usually the sludge must be accumulated in a positive displacement device such as another open tank, and transported for disposal by the segregation of the sludge components.

SUMMARY OF THE INVENTION

A vehicle for the removal of sludge from the interior bottom of liquid storage tanks is disclosed which includes an improved gathering arm for propelling the vehicle to the sludge to be removed and the sludge to be removed to the vehicle. The vehicle includes a gathering header at the lead edge of the vehicle. A gathering arm reaches out and gathers sludge between the vehicle and arm—urging the sludge toward the header of the vehicle and the vehicle towards the sludge. The gathering header on the vehicle has a resiliently biased, floor-mounted brass scraper with a cross feeding auger. The cross feeding auger in combination with the header body receives the material forced into the header by the gathering arm. This cross feeding auger has opposed auger flights for receiving material along the length of the header and gathering the received material to a central portion of the header. Underlying the receiving central portion of the header there is positioned a super charging auger series feeding a progressive cavity positive displacement pump. This progressive cavity positive displacement pump ("progressive cavity pump") discharges to a macerator for pulverizing solid particles.

The vehicle is served and powered by applicable hydraulic lines, electrical service lines, a cutter stock supply line and a recirculating discharge line for transporting the sludge from the vehicle and out of the tank. These respective lines are mounted on a system of support wagons and pulled in the wake of the machine during cleaning movement over the bottom of the tank. A small amount of cutter stock is introduced in the super charging auger to ensure lubricity of the progressive cavity pump; a large amount of cutter stock is introduced after the progressive cavity pump for dissolving bottom settled sludge received into the discharge line. The positive displacement progressive cavity pump prevents the cutter stock from seeing its way along a reverse path to the tank. The macerator takes any solid material passing the pump and pulverizes the material so that it may be removed from the tank. The cutter stock and dissolved sludge are returned to separator apparatus for removal of sludge and recirculation of the cutter stock to the vehicle. Conventional maneuvering of the vehicle occurs on a paired series connected hydraulic driven rubber wheels at the side of the operator directed vehicle. There results a light and portable sludge removing vehicle which can be passed in pieces through the manhole of a tank, assembled, and maneuvered without the loss of traction that has hindered similar vehicles in the past.

Other Objects, Features and Advantages

An object of this invention is to provide motive power to a sludge collecting vehicle passing over the bottom of a tank bottom having an accumulation of sludge. This vehicle has a header including sludge a gathering auger and bottom scrapping scupper. An over reaching arm is hydraulically mounted to the vehicle. This arm reaches out ahead of the vehicle and gathers sludge to the header. In such gathering, the sludge is brought to the vehicle and the vehicle brought to the sludge. There is provided to the vehicle a scissors action between the sludge gathering header and outreaching arm that substitutes for the otherwise required traction for maneuvering the vehicle.

An advantage of the out reaching arm is that sludge can be gathered by a light vehicle. Otherwise weak and fragile tank bottoms experience minimal damage from the passage over their bottom surfaces of the vehicle during the cleaning process. Further, a light vehicle which can be disassembled, passed through a narrow entrance to the tank—such as a conventional manhole, and reassembled in the narrow confines of the tank is made possible.

An additional advantage of the arm mechanism is that it is capable of accommodating various types of scrapers. For example, an aluminum rake composes of discrete teeth can be used for spark resistant bottom scraping. Alternately, and in combination with the rake, a rubber squeegee can be utilized for final, thorough clean of the tank bottom.

A further object of this invention is to facilitate the transport of the sludge from the interior environment of the tank. Accordingly, the vehicle is serviced by a trailing umbilical conduit extending from the interior of the tank at the vehicle to the exterior of the tank at separator apparatus. The header mechanism includes opposed auger flights for gathering sludge to the center of the header. A manifold below the center of the header series feeds a super charging auger pump series connected to a progressive cavity pump. A small flow of cutter fluid is provided to the super charging auger and a large flow of cutter fluid is provided to a discharge conduit immediate the discharge from the progressive cavity pump. There results a sludge collection vehicle having the capability of entraining collected sludge within a cutter fluid solution to enable conduit transport for the separation of the sludge at a connected separation site outside of the tank.

An advantage of this cutter solution transport of the sludge is that dissolution of the sludge occurs at the vehicle within the tank. Transport of the collected sludge is vastly simplified.

A further advantage of the header connected positive displacement progressive cavity pump is that the pump acts as a check against the introduction of cutter stock to the interior of the tank. Accordingly, highly volatile cutter stocks can be utilized. Cutter stocks such as hexane—normally not used because of their extremely explosive vapors—can be utilized with the tank cleaning apparatus and process here set forth.

DETAILED DESCRIPTION OF THE PREFERRED EMBODIMENT

Figure 1A:
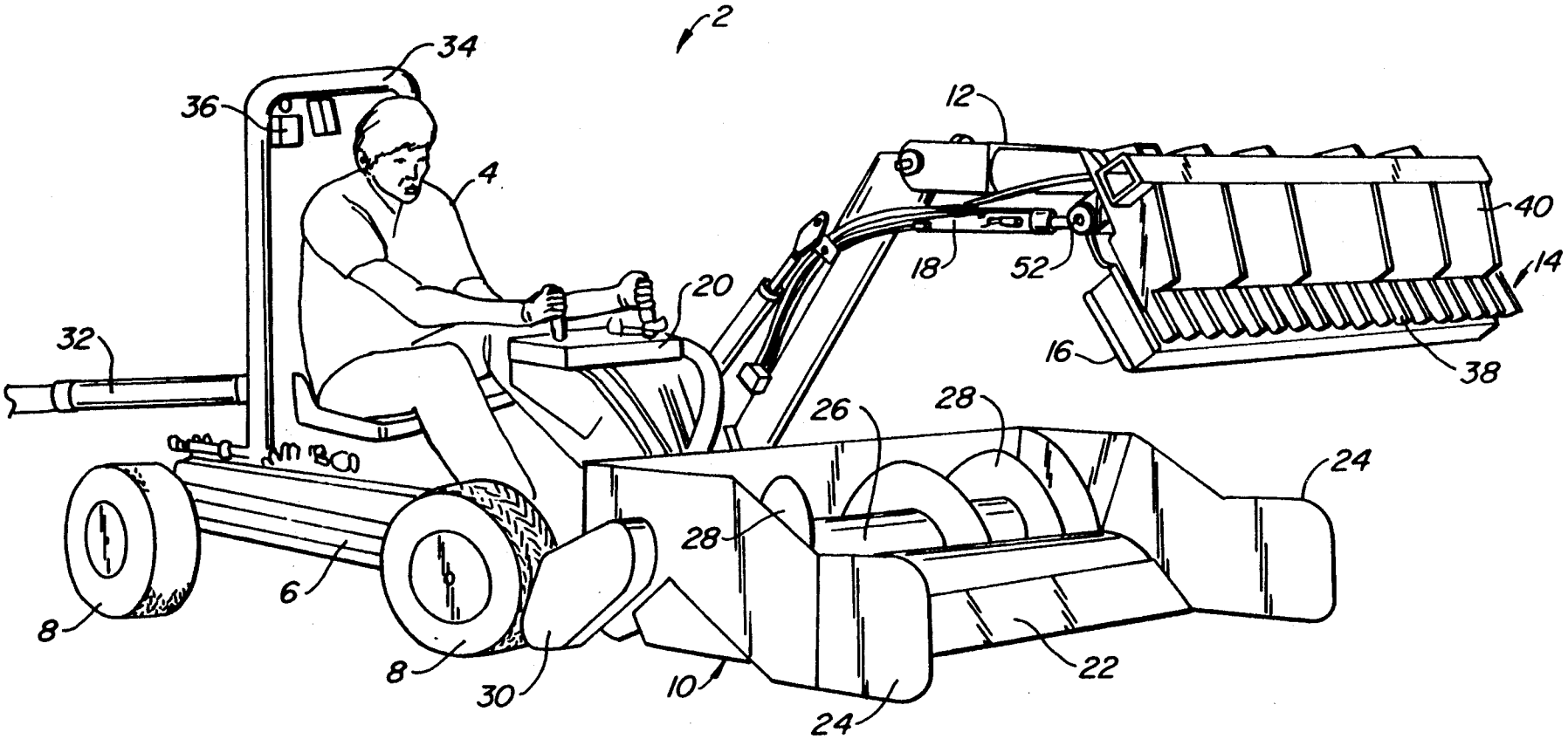
FIG. 1A is a perspective view of the apparatus for sludge removal illustrating the sludge gathering arm reaching for gathering accumulated sludge to the machine header for processing and dissolving with eventual removal from the tank.

Referring to FIG. 1A, vehicle for sludge removal 2 is illustrated having an operator 4 seated on vehicle chassis 6. Vehicle chassis includes roll bar 34 to protect operator in the event of roll over. Additionally, explosion proof lights 36 are secured to vehicle 2 to provide light in low light situations. Vehicle chassis 6 is the primary supporting member for all the components of the vehicle 2 and is supported by two pairs of hydraulically driven rubber wheels 8 which propel and steer vehicle 2 by a hydraulically controlled four-wheel drive power train. The vehicle 2 can be maneuvered like a conventional tractor, each side of the chassis 6 having a pair of wheels which can be driven in tandem in forward or reverse.

Apparatus for sludge removal 2 includes machine header 10 and a hydraulically controlled sludge gathering arm 12. Gathering arm 12 supports a positionable shovel 40 having rake 14. Rake 14 includes a series of aluminum teeth 38. Pivotally mounted to shovel 40 is a movable rubber squeegee 16 which can be positioned adjacent rake 14 or folded up away from rake 14. Squeegee 16 is on the header 10 side of rake 16. Machine header 10 has a floor mounted brass scraper 22 positioned between a pair of forward extending header sidewalls 24, and in front of a transverse auger 26 having opposed auger flights 28. In the preferred embodiment, machine header 10 can be raised and lowered by the operator 4 using a hydraulically controlled header pivot 30.

Gathering arm 12 and machine header 10 work in combination to gather sludge to be removed from in front of the vehicle 2. Gathering arm 12 is hydraulically controlled by operator 4 using a suitable control console 20 to mechanically reach out and gather sludge between the header 10 and shovel 40. Operator 4 manipulates gathering arm 12 to reach out and pull in the sludge being gathered into machine header 10 between header sidewalls 24.

Figure 1B:
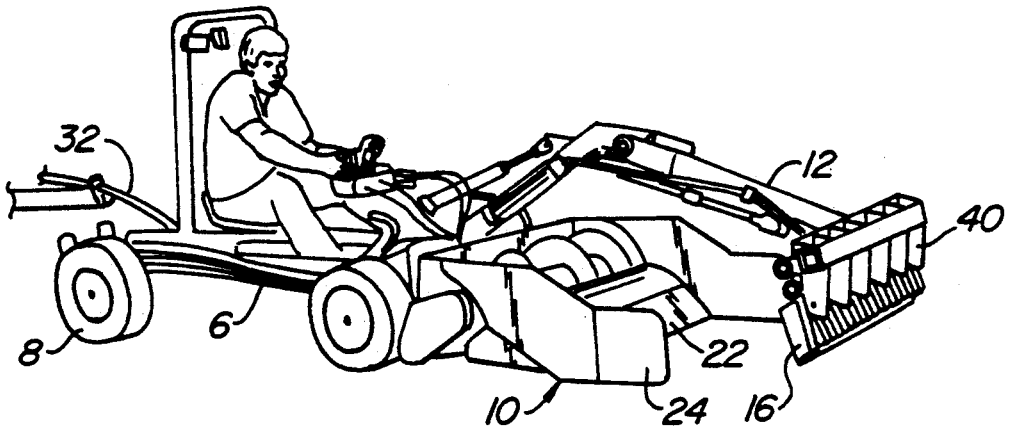
FIG. 1B is a perspective view similar to FIG. 1A on a reduced scale with the sludge gather arm extended and lowered for trapping sludge—not shown—between the machine header and arm for propelling the machine to the sludge and the sludge to the machine for removal from the tank bottom.
Figure 1C:
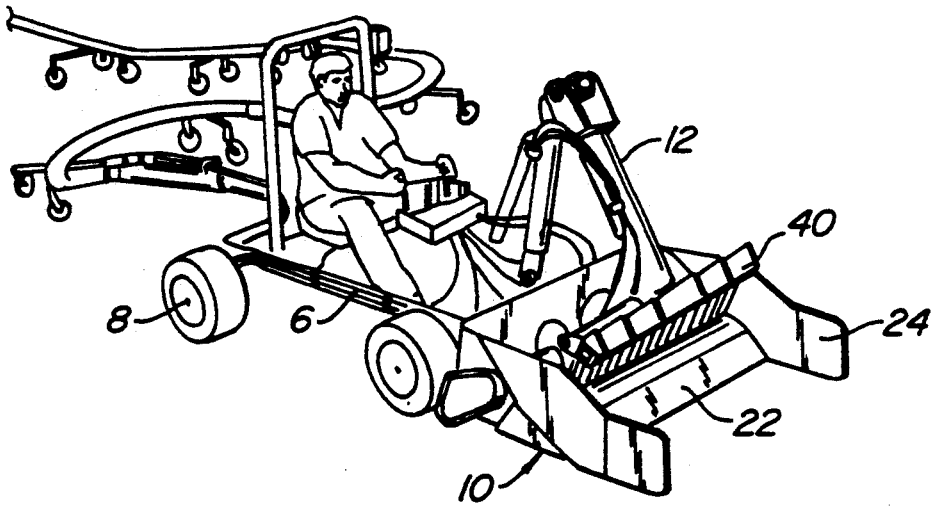
FIG. 1C is a perspective view similar to FIG. 1B with the gathering arm fully retracted to the machine header for the loading of gather sludge to the machine header for processing.

FIGS. 1B and 1C illustrate the positioning of gathering arm 12 to collect sludge (not shown). Gathering arm 12 is positioned to reach out and pull in sludge being gathered into machine header 10 as shown in FIG. 1C. Suitable stops are used to limit the movement of gathering arm 12 such that shovel 40, rake 14 or rubber squeegee 16 do not contact the transverse auger 26 during operation. Once sludge is pulled into machine header 10, the sludge rides over brass scraper 22 into transverse augers 26. Brass scraper 22 resiliently mounted or is resiliently mounted on machine header 10 so that it resiliently biases downwardly towards the floor and skims the floor of the tank being cleaned. This feature provides a good seal on the floor and helps prevent sludge from traveling under the machine header 10 by directing the sludge into opposed auger flights 28. Opposed auger flights 28 act to direct the sludge collected into machine header 10 to a flow path which includes a central region of machine header 10 where a perpendicular screw, located beneath the shaft of the transverse augers 26, force feeds a progressive cavity pump as more fully described below.

Figure 2A:
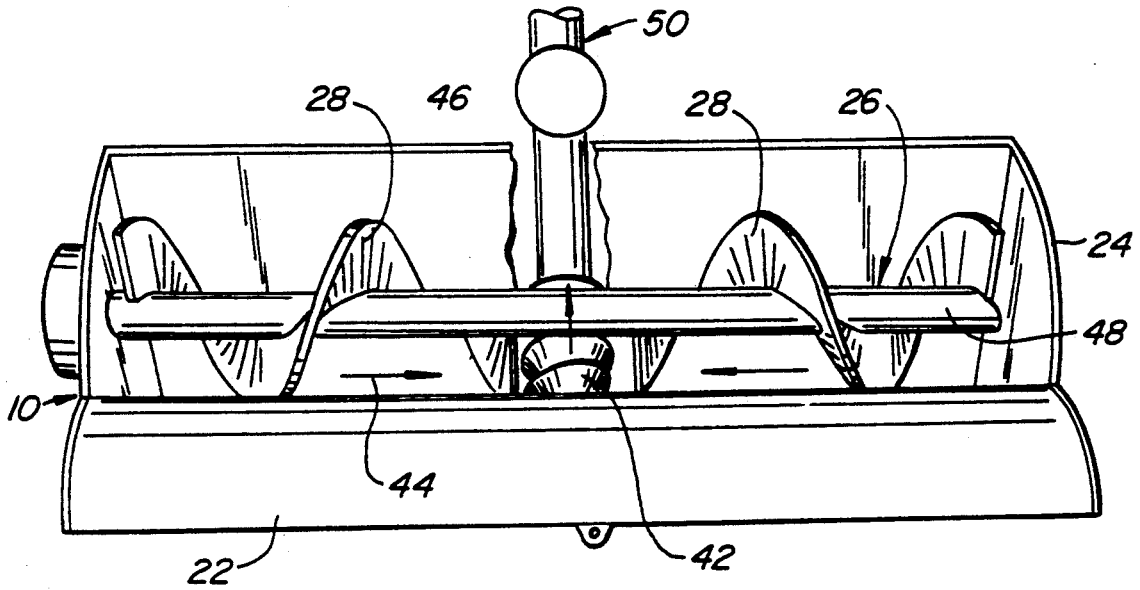
FIG. 2A is a perspective view of the machine header showing the opposed auger flights for collecting sludge impelled by the gathering arm to the central processing auger pump, feeder progressive cavity pump, macerator and discharge line.

FIG. 2A is an illustration of machine header 10 showing transverse auger 26 having an auger shaft 48 with opposed auger flights 28 which direct the sludge collected from across the length of brass scraper 22 from the sides into a center location as indicated by arrows 44 where it is then directed into a processing and discharge path 50 by a super charging auger 42 as indicated by arrow 46.

Figure 3:
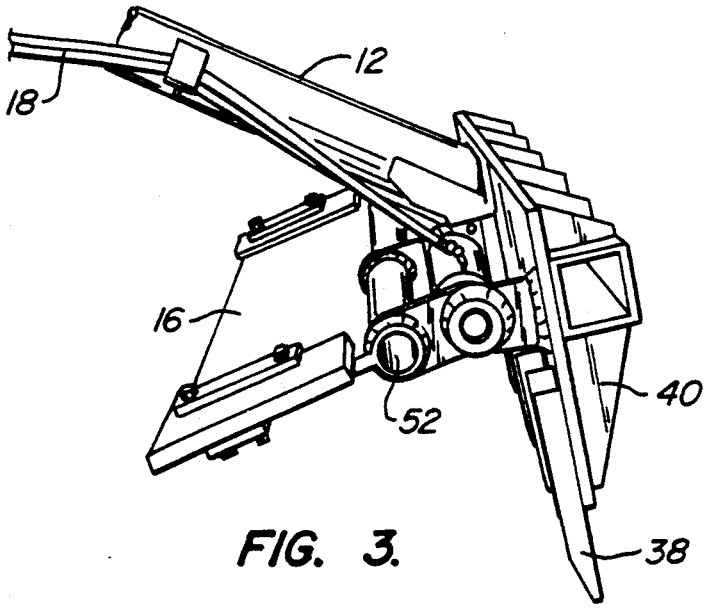
FIG. 3 is a detail of the gathering arm illustrating in the perspective side view the squeegee with its cooperative folding action with respect to the gather teeth of the gathering arm.

Gathering arm 12 is made to perform two functions. In addition to providing a mechanism for gathering and pulling collected sludge into machine header 10, gathering arm 12 also provides a means of positioning vehicle 2 when the surface being cleaned is so slippery that rubber wheels 8 do not provide sufficient traction. Shovel 40 is equipped with a row of aluminum gathering teeth 38 which can be used to rake thick sludge material into machine head 10. In addition, when the majority of sludge material has been removed and only a relatively thin film remains, rubber squeegee 16 can be manipulated up or down when necessary to allow rubber squeegee 16 to be used as a shoveling squeegee surface resilient enough to allow it to be scraped along a metallic floor of a oil storage tank without causing damage to the floor. Gathering arm 12 is shown in FIG. 3 having rubber squeegee positioned away from aluminum gathering teeth 38. Rubber squeegee 16 can be positioned between an active and inactive condition using appropriate hydraulic control lines 18 to allow it to pivot about a squeegee pivot 52. In the preferred embodiment, the entire vehicle 2 is fabricated from rubber, plastic, stainless steel, bronze and aluminum components to minimize weight and maximize spark resistance and reduce the potential of fire hazard caused by potential sparks generated during operation of the device in a metallic storage tank.

Figure 4:
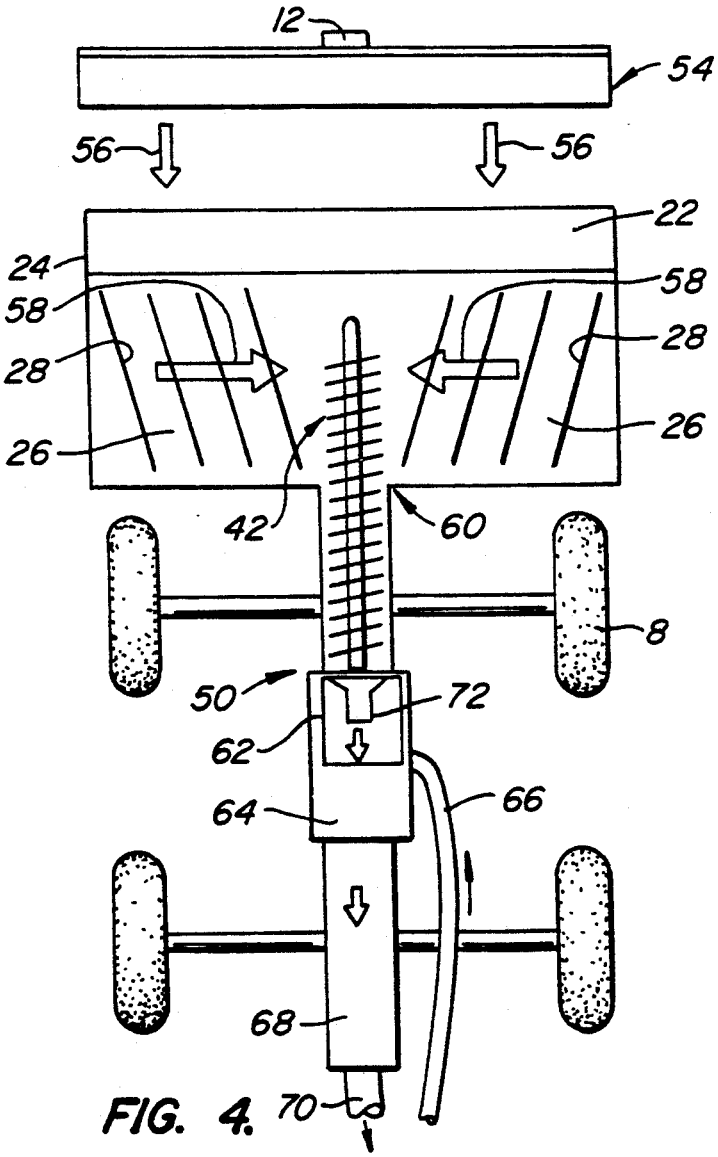
FIG. 4 is a schematic illustrating the machine processing of the gathered sludge by the successive action of the gathering arm, machine header, opposed augers, super charging auger, progressive cavity pump and finally a macerator having ultimate discharge into the discharge line for evacuation and processing of the dissolved sludge.

Referring now to FIG. 4, the operating components of vehicle 2 and the process facilitated therein will be more fully described. FIG. 4 shows vehicle 2 illustrated functionally with gathering means 54 formed from rubber squeegee 16 mounted to gathering arm 12. Squeegee 16 and gathering arm 12 are manipulated to collect and pull the sludge or other material being gathered into machine header 10 as indicated by arrows 56. The sludge passes over brass scraper 22 into a cross feed formed by transverse auger 26 having opposed auger flights 28. Opposed auger flights 28 centrally direct sludge, as indicated by arrow 58, into a processing and discharge path 50. Processing and discharge path 50 comprises supercharging auger 42 disposed in receiving conduit 60, a positive displacement pump 62, a mixing chamber 64 connected to and fed by a cutter stock supply conduit 66, and a macerater 68 connected to a discharge line 70 which directs the sludge and cutter stock slurry formed in mixing chamber 64 to a separator apparatus (not shown).

Supercharging auger 42 is connected to a small liquefier jet to introduce a small amount of lubricating fluid or cutter stock in front of the positive displacement pump 62 to supply the required lubricity to reduce friction and facilitate continual flow through the positive displacement pump 62. At the tail end of the progressive cavity pump 72, cutter stock supply conduit 66 connects with the processing end discharge path 50 to introduce cutter stock into the flow of sludge material. Because the progressive cavity pump is a positive displacement device, liquid introduced into the flow path through the cutter stock supply conduit 66 is prevented from traveling through the processing and discharge path 50 towards and back into the liquid storage tank. Functionally, the progressive cavity pump acts as a check valve to prevent reverse flow of the sludge material.

Any suitable cutter stock could be used, however, in the preferred embodiment, Diesel oil or water is used. Cutter stock is introduced near the tail end of the progressive cavity pump through the cutter stock supply conduit 66 into a mixing chamber region 64 where the cutter stock becomes entrained in the sludge to help dissolve the sludge and reduce its viscosity. The cutter stock and sludge mixture then enters a macerator 68 which pulverizes any solid material or debris which is contained within the sludge flow. The sludge then exits out of the macerator to a discharge line 70 where it is pumped to a separator apparatus (not shown) where the cutter stock is separated from the sludge being removed. The cutter stock is then recirculated back to the processing and discharge path 50 through cutter stock supply conduit 66 in a closed loop fashion. In the preferred embodiment, the amount of cutter stock introduced into mixing chamber 64 is metered and controllable by the operator by suitable means. The cutter stock is introduced downstream of the progressive cavity pump 72 in processing and discharge path 50. Because the progressive cavity pump 72 is a positive displacement device, cutter stock is restricted from traveling upstream of the processing and discharge path 50, therefore eliminating the potential that the cutter stock could enter the liquid storage tank. This feature allows cutters such as hexane, which is highly explosive, to be used.

Figure 2B:
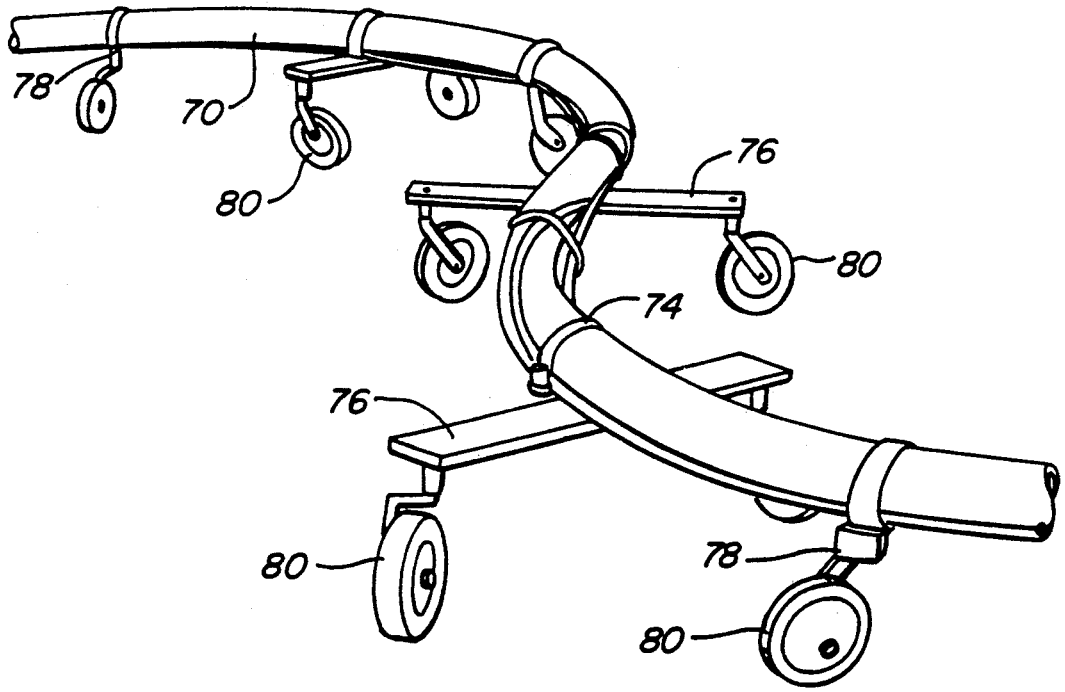
FIG. 2B is a perspective view of the discharge line illustrating carriages for towing the line in the wake of the machine over the surface of the tank.

Macerator 68, in the preferred embodiment, comprises a high velocity rotating square shaft propelled by a hydraulic motor. The axis of the shaft is perpendicular to the inflow and outflow path through the macerator. The shaft carries several bladed cutters which are rotated at a high speed to mix rust, sludge and cutter stock as well as shred solid debris contained in the material flow which is otherwise not effected by the cutter stock, before the material is purged through the discharge line 70. In function, the macerator 68 works as a type of grinder which reduces the possibility of particulate matter or solid debris such as gloves or other foreign objects, from following or collecting in discharge line 70 thereby inhibiting flow to separator apparatus (not shown). This allows the processing and discharge path 50 to maintain a high flow volume of sludge-cutter stock slurry through discharge line 70. The components within processing and discharge path 50, particularly positive displacement pump 62, supercharging auger 42 and macerator 68 are all reversible. To reverse the flow of the material when necessary to purge foreign objects such as clothing, shoes, wire, rags, nuts or bolts, or other solid material which are pulled into the processing and discharge path 50 through machine header 10. FIG. 2B shows discharge line 70 and cutter stock supply conduit 66 secured together using securing ties 74 and supported by support carriages 76 and trailing wheels 78. Swiveling castor wheels 80 are mounted to both support carriages 76 and trailing wheels 78 to allow discharge line 70 to freely trail behind apparatus for removing sludge 2. As the apparatus for removing sludge 2 is manipulated within a liquid storage tank in the process of collecting sludge, discharge line 70 is free to swing about and conform to the necessary positioning of apparatus for removing sludge 2 while minimizing its maneuverability.

All the hydraulic lines used for the control of the moving parts, including the header pivot 30, drive train for rubber wheels 8, gathering arm 12, positionable shovel 40, and squeegee pivot 52 all use conventional pressure relief valves and hydraulic controls to prevent damage to the hydraulic system and provide complete operator control. In an alternative embodiment of the invention, manual control of the apparatus for removing sludge 2 is made remote or automated. The hydraulics facilitate robotic adaptation eliminating the need for human operator 4. The major components of the vehicle are connected together using suitable quick disconnect means such as wingnuts, counterpins and the like. This allows the apparatus to be quickly assembled and dissembled to ease transportation storage and placement in liquid storage tanks.

Figure 5:
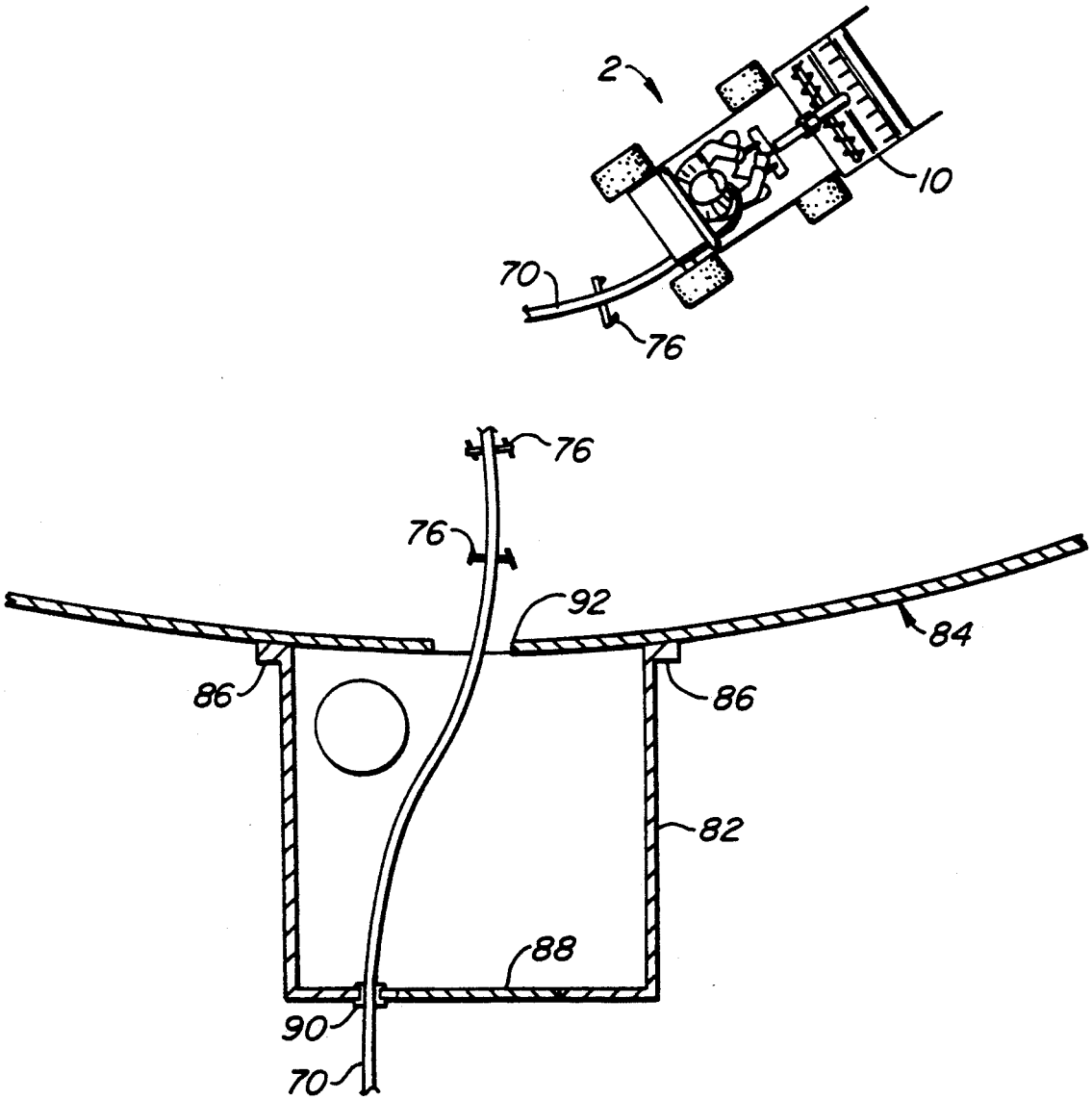
FIG. 5 is a plan view of the apparatus of this invention operating through an air lock installed at the manhole of a tank, the apparatus shown with an operator wearing remote breathing apparatus for cleaning of the tank without discharge of vapors to the atmosphere.

Because cleaning of oil storage tanks necessitates cleaning under a gas or vapor-rich atmosphere within the tank, applicable Clean Air Act provisions must be followed. The method for removing sludge will now be described. The description will be to the removal of sludge from an oil tank, but the method can be applied to any liquid storage tank. Referring now to FIG. 5, the process for removing sludge using the vehicle 2 begins by first securing an air chamber 84 to an oil storage tank to be cleaned 84 using large magnets 86 secured to air chamber 84 and forming an airtight seal between air chamber 82 and oil tank 84. Air chamber 82 includes a sealable door 88 and a discharge line aperture 90 to allow discharge line 70 to pass through it once the vehicle 2 is positioned inside oil storage tank 84. Air chamber 82 is positioned over a previously existing storage tank man-hole 92 or a new man-hole is cut. Liquified propane gas may be used to raise the gas vapor content inside the oil storage tank 84 to achieve a gas-rich atmosphere. An operator wearing a suitable oxygen supply or space suit, enters the air chamber with the unassembled components of apparatus for removing sludge 2. Door 88 is then closed to create an airtight vessel comprised of the oil storage tank 84 and air chamber 82.

The component parts are then transported through the man-hole where the entire apparatus can be completely assembled due to its quick disconnect and connect features. Discharge line is threaded external to the chamber through a discharge line aperture 90 where it is connected with the suitable separator apparatus previously discussed. The operator then manipulates the apparatus for removing sludge to collect all the sludge and debris contained in the oil storage tank 84 by scooping sludge into machine header 10 using gathering arm 12. Paired rubber wheels 8, driven by suitable hydraulic drive means, are used to position the vehicle while gathering the sludge. When traction is minimal and the wheels provide insufficient maneuverability, gathering arm 12 can be used to pull the vehicle chassis 6 and in turn the machine header 12 towards the plane of shovel 40 by asserting sufficient hydraulic force through gathering arm 12 such that squeegee 16 or shovel 40 provide an anchor on the floor of the oil storage tank and the hydraulics are used to pull the vehicle chassis towards the shovel 40. In either event, the operator collects the sludge contained within the storage tank by feeding it into the processing and discharge path 50 where it is discharged outside of the oil storage tank through discharge line 70 and collected for suitable storage or disposal.

The gas-rich atmosphere allows the cleaning process to occur with a minimum of vapor or gas emissions. If large particulate matter or solid debris lodge within the processing and discharge path 50, the operator simply stops the vehicle 2 and allows the liquefier feeding into central receiving conduit 60 to clear out the processing and discharge path 50 by introducing sufficient fluid into the path 50. Once the path is clear, the liquefier can be turned off and the operator can reverse the flow of the supercharging auger 42 and positive displacement pump 62 as well as macerator 68 to spit the clogging matter out of the machine through the machine header 10. In the preferred embodiment, a conventional deadman shutoff circuit is used to allow the operator to dismount from the vehicle 2 and physically pick up the purged object. The operator can then remount the vehicle 2 for the relief of the deadman circuit, restart the vehicle 2, and continue the sludge removal process.

The foregoing description of the preferred embodiments of the invention have been presented for purposes of illustration and description. It is not intended to be exhaustive or to limit the invention to the precise form disclosed, and obviously many modifications and variations are possible in light of the above teaching. Embodiments chosen and described in this description were selected to best explain the principles of the invention and its practical application to thereby enable others skilled in the art to best utilize the invention and various embodiments and with various modifications as are suited to the particular use contemplated. It is intended that the scope of the invention be defined by the claims appended hereto.

What is claimed is:

1. A vehicle for the removal of sludge from the interior bottom of liquid storage tanks comprising:

a chassis having a lead edge;

means for propelling said chassis over the bottom of an oil storage tank;

a gathering arm attached to said vehicle at one end and extending away from said vehicle at the opposite end;

means for scraping mounted to said gathering arm at the end of said arm remote from said chassis;

means for moving said gathering arm relative to said chassis for positioning said scraper on the bottom of said liquid storage tank remote from said chassis and propelling said scraper toward said chassis whereby the sludge to be gathered between said scraper and chassis is moved to said chassis or said chassis is moved to said sludge;

a gathering header at the lead edge of said chassis for receiving said sludge, said gathering header having a leading edge exposed to said gathering arm for the receipt of sludge, confining side walls for the confinement of received sludge and a discharge aperture for discharging gathered sludge received and confined in said header;

auger means mounted within said gathering header for moving sludge received at said leading edge of said header to said discharge aperture of said header;

a flow conduit attached to said chassis for receiving from said discharge aperture of said header accumulated sludge for removal of said sludge from said chassis to the exterior of said tank;

a positive displacement pump placed between the discharge aperture of said header and said flow conduit for pumping said sludge from said header to said conduit and preventing back flow of sludge from said conduit to said header, said positive displacement pump having a discharge;

a cutter stock supply conduit communicated to said flow conduit for supplying cutter stock to the discharge of said positive displacement pump for dissolving and rendering transportable sludge discharged from said positive displacement pump whereby dissolved sludge is removed from said tank.

2. The invention of claim 1 and wherein said header includes:

a resiliently biased scraper depending from the leading open edge of said header.

3. The invention of claim 2 and wherein said means for scraping mounted on said gathering arm includes:

depending teeth for penetration into said sludge.

4. The invention of claim 1 and wherein said means for scraping mounted on said gathering arm includes a rubber squeegee blade.

5. The invention of claim 1 and wherein said means for scraping mounted on said gathering arm includes a solid scraper.

6. The invention of claim 1 and wherein said means for scraping mounted on said gathering arm includes depending teeth for penetration into said sludge;

a solid scraper pivotally mounted with respect to said depending teeth; and, means for moving said solid scraper pivotally towards and away from said teeth.

7. The invention of claim 1 including:

a supercharging auger attached to the discharge of said header, said supercharging auger having an intake at said discharge and an outlet to said positive displacement pump.

8. The invention of claim 1 and wherein said positive displacement pump is a progressive cavity pump.

9. The invention of claim 1 and including a macerator, said macerator having an intake at the discharge of said positive displacement pump and a discharge to said discharge conduit.

10. A vehicle for the removal of sludge from the bottom of a tank utilized in the storage of liquids, said vehicle comprising in combination;

a mixing chamber having a first portion for receiving and second portion for discharging sludge;

a vehicle chassis for the support of said mixing chamber;

means for propelling and steering said chassis over the bottom of said tank for the removal of sludge in the path of said chassis;

a cutter stock supply conduit for communication to a cutter stock supply source at a receiving end and discharging said cutter supply stock to said mixing chamber at said second portion for the dissolving of sludge in said cutter stock in said mixing chamber;

a discharge conduit communicated to said mixing chamber at said second portion for receiving said cutter stock and dissolved sludge at a receiving end and having a discharge exterior of said tank;

gathering means for receiving sludge in the path of said chassis and directing said sludge to said first portion of said mixing chamber;

a positive displacement pump for pumping said sludge from said first portion of said mixing chamber to said second portion of said mixing chamber with said positive displacement pump therebetween preventing back flow of cutter stock and dissolved sludge from said first portion of said mixing chamber to said second portion of said mixing chamber whereby said cutter stock and dissolved sludge can be gathered interior of said tank and discharged from said tank with said positive displacement pump forming a barrier for preventing back flow of said cutter stock interior of said tank being cleaned.

11. The invention of claim 10 and wherein said gathering means includes a header, the header coupled to said vehicle chassis and including an interior and a discharge.

12. The invention of claim 11 and wherein said header includes:

a leading open edge;

a resiliently biased scraper depending from the leading open edge for receiving sludge impelled towards the interior of said header.

13. The invention of claim 12 and wherein said scraper includes:

depending teeth for penetration into said sludge.

14. The invention of claim 12 and wherein said scraper on said gathering arm includes a solid scraper.

15. The invention of claim 12 and wherein said scraper on said gathering arm includes depending teeth for penetration into said sludge;

a solid scraper pivotally mounted with respect to said depending teeth; and, means for moving said solid scraper pivotally towards and away from said teeth.

16. The invention of claim 11 and wherein including:

a supercharging auger attached to the discharge of said header, said super charging auger having an intake at said discharge and an outlet to said positive displacement pump.

17. The invention of claim 10 and wherein said positive displacement pump is a progressive cavity pump.

18. The invention of claim 10 and including a macerator, said macerator having an intake at the discharge of said positive displacement pump and a discharge to said discharge conduit.

19. A vehicle for the removal of sludge from the bottom of a tank utilized in the storage of liquid, said vehicle comprising in combination:

a mixing chamber having a first portion for receiving and second portion for discharging sludge;

a vehicle chassis for the support of said mixing chamber;

means for supporting said chassis for movement over the bottom of said tank for the removal of sludge in the path of said chassis;

a cutter stock supply conduit for communication to a cutter stock supply source at a receiving end and discharging said cutter supply stock to said mixing chamber at said second portion for the dissolving of sludge in said cutter stock in said mixing chamber;

a discharge conduit communicated to said mixing chamber at said second portion for receiving said cutter stock and dissolved sludge at a receiving end and having a discharge exterior of said tank;

means for receiving sludge in the path of said chassis and discharging sludge to said first portion of said mixing chamber;

a sludge gathering scraper for movement from a position removed from said means for receiving sludge to a position adjacent said means for receiving sludge with sludge disposed therebetween for causing sludge to be urged to and toward said means for receiving sludge;

scraper moving means attached to said chassis at one end and to said sludge gathering scraper at the other end for moving said sludge gathering scraper to said chassis at said means for receiving sludge;

a positive displacement pump for pumping said sludge from said first portion of said mixing chamber to said second portion of said mixing chamber with said positive displacement pump therebetween preventing back flow of cutter stock and dissolved sludge from said first portion of said mixing chamber to said second portion of said mixing chamber whereby said cutter stock and dissolved sludge can be gathered interior of said tank and discharged from said tank with said positive displacement pump forming a barrier for preventing back flow of said cutter stock interior of said tank being cleaned.

20. The invention of claim 19 and wherein said means for receiving sludge includes:

a header, said header including an open end for receiving said sludge and a discharge aperture;

a resiliently biased scraper depending from the leading open edge of said header for receiving sludge impelled over the bottom of said tank to the interior of said header.

21. The invention of claim 19 and wherein said scraper moving means includes:

a gathering arm, said gathering arm attached to said vehicle chassis at one end and to said sludge gathering scraper at said other end;

means for moving said gathering arm in motion towards and away from said vehicle whereby said sludge gathering scraper can move sludge to said means for receiving sludge.

22. The invention of claim 21 and wherein said sludge gathering scraper on said gathering arm includes a solid scraper blade.

23. The invention of claim 21 and wherein said sludge gathering scraper on said gathering arm includes depending teeth for penetration into said sludge;

a solid scraper blade pivotally mounted with respect to said depending teeth; and, means for moving said solid scraper blade pivotally towards and away from said teeth.

24. The invention of claim 21 and wherein including:

a supercharging auger attached to the first portion of said mixing chamber, said super charging auger having an intake at said means for receiving sludge and an outlet to said positive displacement pump.

25. The invention of claim 21 and wherein said positive displacement pump is a progressive cavity pump.

26. The invention of claim 21 and including a macerator, said macerator at the second portion of said mixing chamber and having an intake at the discharge of said positive displacement pump and a discharge to said discharge conduit.

27. A vehicle for the removal of sludge from the bottom of a tank utilized in the storage of oil, said vehicle comprising in combination:

a vehicle chassis for the support of an operator;

driving the wheels for propelling said vehicle;

steering means operably connected with said driving wheels for directionally propelling said vehicle chassis across the bottom surface of said tank for the removal of sludge from said tank;

a central receiving conduit for receiving and discharging sludge;

a header coupled to said central receiving conduit and having a side edge;

a gathering arm, said arm mounted to said chassis at one end and having a gathering surface at the opposite end;

means for moving said gathering arm to said header with said sludge between said gather surface and said header whereby sludge is propelled to said header and said vehicle is propelled by said arm to said sludge;

opposed augers disposed in said header, said opposed augers including first and second opposed auger flights for receiving sludge at said header and moving sludge from the side edge of said header to the central portion of said header at said central receiving conduit;

a super charging auger disposed in said central receiving conduit for receiving sludge from said opposed augers at one end and discharging sludge at the opposite end;

a progressive cavity pump disposed in said central receiving conduit after said super charging auger for moving sludge under positive displacement pumping from said super charging auger at an intake end of said progressive cavity pump to a discharge end of said progressive cavity pump;

a mixing chamber communicated to the discharge of said progressive cavity pump;

a macerator in said central receiving conduit communicated to the outlet of said progressive cavity pump for receiving and pulverizing particulate matter in said sludge;

a cutter stock supply conduit for communication to a cutter stock supply source at a receiving end and discharging said cutter supply stock to said mixing chamber for the dissolving of cutter stock in said mixing chamber; and, a discharge conduit communicated to said mixing chamber for receiving said cutter stock and dissolved sludge at a receiving end and having a discharge exterior of said tank whereby said cutter stock and dissolved sludge can be gathered interior of said tank and discharged from said tank.

28. The invention of claim 27 and wherein said header includes:

a generally downwardly biased scraper depending from a leading open edge of said header.

29. The invention of claim 27 and wherein said scraper on said gathering arm includes:

depending teeth for penetration into said sludge.

30. The invention of claim 27 and wherein said gathering surface on said gathering arm includes a solid scraper.

31. The invention of claim 27 and wherein said gathering surface on said gathering arm includes depending teeth for penetration into said sludge;

a solid scraper pivotally mounted with respect to said depending teeth; and, means for moving said solid scraper pivotally towards and away from said teeth.

32. A vehicle for the removal of sludge from the bottom of a tank utilized in the storage of liquids, said vehicle comprising:

a mixing chamber having a first portion for receiving and second portion for discharging sludge;

a vehicle chassis for the support of said mixing chamber;

a cutter stock supply conduit for communication to a cutter stock supply source at a receiving end and discharging said cutter supply stock to said mixing chamber generally near said second portion for the dissolving of sludge in said cutter stock in said mixing chamber;

a discharge conduit communicated to said mixing chamber near said second portion for receiving said cutter stock and dissolved sludge at a receiving end and having a discharge exterior of said tank;

a gathering assembly for directing sludge to said mixing chamber, the gathering assembly including a scraper coupled to said vehicle chassis and means for moving the scraper and the vehicle chassis relative to each other, wherein sludge positioned between the scraper and the vehicle chassis is directed into the first portion upon moving the scraper and the vehicle chassis generally towards each other; and a pump for pumping said sludge from said first portion of said mixing chamber to said second portion of said mixing chamber.

* * * * *